US006630624B2

(12) United States Patent
Tsao et al.

(10) Patent No.: US 6,630,624 B2
(45) Date of Patent: Oct. 7, 2003

(54) ELECTRICAL CABLE WITH GROUNDING MEANS

(75) Inventors: Pei Tsao, Cypress, CA (US); Frank Quach, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/037,065

(22) Filed: Nov. 8, 2001

(65) Prior Publication Data

US 2003/0085052 A1 May 8, 2003

(51) Int. Cl.[7] ..... H01B 11/06; H01B 11/02
(52) U.S. Cl. ..... 174/36; 174/113 R; 174/117 F
(58) Field of Search ..... 174/36, 113 R, 174/117 F, 107, 102 R, 116, 117 FF, 28

(56) References Cited

U.S. PATENT DOCUMENTS 4,096,346 A * 6/1978 Stine et al. ..... 174/36
4,234,759 A * 11/1980 Harlow ..... 122/228
4,281,212 A * 7/1981 Bogese, II ..... 174/36
4,383,725 A * 5/1983 Bogese et al. ..... 439/391
4,424,403 A * 1/1984 Bogese, II ..... 174/36
4,588,852 A * 5/1986 Fetterolf et al. ..... 174/36
5,208,426 A * 5/1993 Kennedy et al. ..... 174/36
5,416,268 A * 5/1995 Ellis ..... 174/36
5,872,334 A * 2/1999 Trazyik ..... 174/36
5,928,028 A * 7/1999 Orsley et al. ..... 439/497
5,964,620 A * 10/1999 Takahashi et al. ..... 439/579
6,031,185 A * 2/2000 Bouveret et al. ..... 174/84 R
6,273,753 B1 * 8/2001 Ko ..... 439/579

FOREIGN PATENT DOCUMENTS

EP 0784327 A1 * 1/1997 ..... H01B/11/00
FR 2646276 * 10/1990 ..... H01B/07/08

* cited by examiner

*Primary Examiner*—William H Mayo, III
(74) *Attorney, Agent, or Firm*—Wei Te Chung

(57) ABSTRACT

An electrical cable (1) adapted for an electrical connector (2) having a number of terminals, has two cable subassemblies (10) each having two signal wires (101) and a metal braid (102) wrapping up thereabout, and a number of drain wires (13, 14) positioned among the two cable subassemblies and conductively contacting with the metal braids. Each drain wire has a center conductor and a semiconductive layer (134) extruded around the center conductor. Distances between center lines of the drain wires and the signal wires are equal to pitches of the terminals of the electrical connector for facilitating soldering procedure.

2 Claims, 5 Drawing Sheets

ELECTRICAL CABLE WITH GROUNDING MEANS

BACKGROUND OF THE INVENTION

1. Field of the Invention

The present invention relates to an electrical cable, and particularly to an electrical cable which provides an improved grounding means.

2. Description of Prior Art

Referring to FIGS. 4 and 5, a conventional electrical cable assembly includes an electrical connector 50 having a plurality of terminals 51 with equal pitches therebetween and an electrical cable 40 connecting therewith for transmitting signals. The electrical cable 40 comprises a pair of cable subassemblies 41. Each cable subassembly 41 includes two signal wires 42 with two outer non-insulated grounding drain wires 43 and a conductive layer 44 surrounding the signal wires 42 and the outer non-insulated grounding drain wires 43. The conductive layer 44 electrically contacts with the outer non-insulated grounding drain wires 43 and ends of the non-insulated grounding drain wires together with ends of signal wires are respectively soldered with corresponding terminals 51 of the electrical connector 50, thus to provide signals with high quality during transmitting. The drain wires are made of metal material, such as copper or copper alloy, aluminum or aluminum alloy, tin-copper alloy, and other metal conductors. However, when the drain wires should be soldered to grounding terminals of the electrical connector, operators have to align the drain wires with the corresponding grounding terminals respectively, which complicates the manufacturing process as well as impairs the manufacturing efficiency. Additionally, such a kind of electrical cable needs considerable non-insulated grounding drain wires, which increases the manufacturing cost.

Hence, an improved grounded electrical cable is required to overcome the disadvantages of the prior art.

BRIEF SUMMARY OF THE INVENTION

Accordingly, the object of the present invention is to provide an electrical cable having an improved grounding means which reduces the cost of the electrical cable and simplifies the manufacturing process thereof.

In order to achieve the object above-mentioned, an electrical cable in accordance with the present invention, which is used with an electrical connector having ground and signal terminals, includes a pair of cable subassemblies parallel to each other, a middle drain wire positioned between the two cable subassemblies and two outer drain wires arranged at outermost sides of the two cable subassemblies, both the middle drain wire and the outer drain wires conductively contacting with the metal braids of the cable subassemblies, and an jacket covering the drain wires and the cable subassemblies. Each cable subassembly comprises two signal wires each having a signal conductor and an insulating layer surrounding the signal conductor, and a metal braid wrapping up the two signal wires. Each drain wire comprises a center conductor and a layer made from semiconductive material being extruded around the center conductor. Pitches between every two adjacent center conductor and signal conductor are equal to pitch between every two signal conductors in a same cable subassembly.

Other objects, advantages and novel features of the invention will become more apparent from the following detailed description of the present embodiment when taken in conjunction with the accompanying drawings.

DETAILED DESCRIPTION OF THE INVENTION

Figure 1:
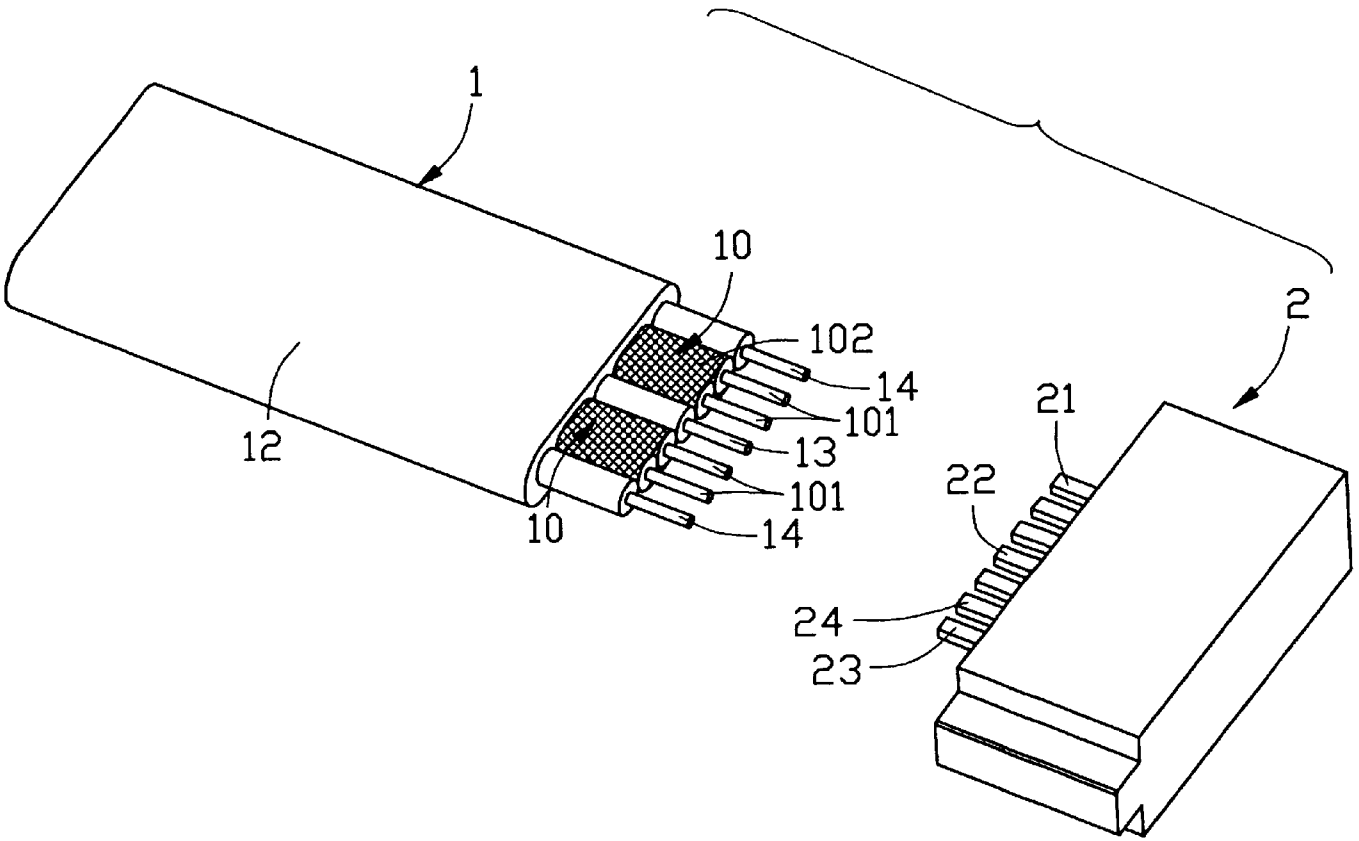
FIG. 1 is an exploded, perspective view of an electrical cable used with an electrical connector in accordance with the present invention.
Figure 2:
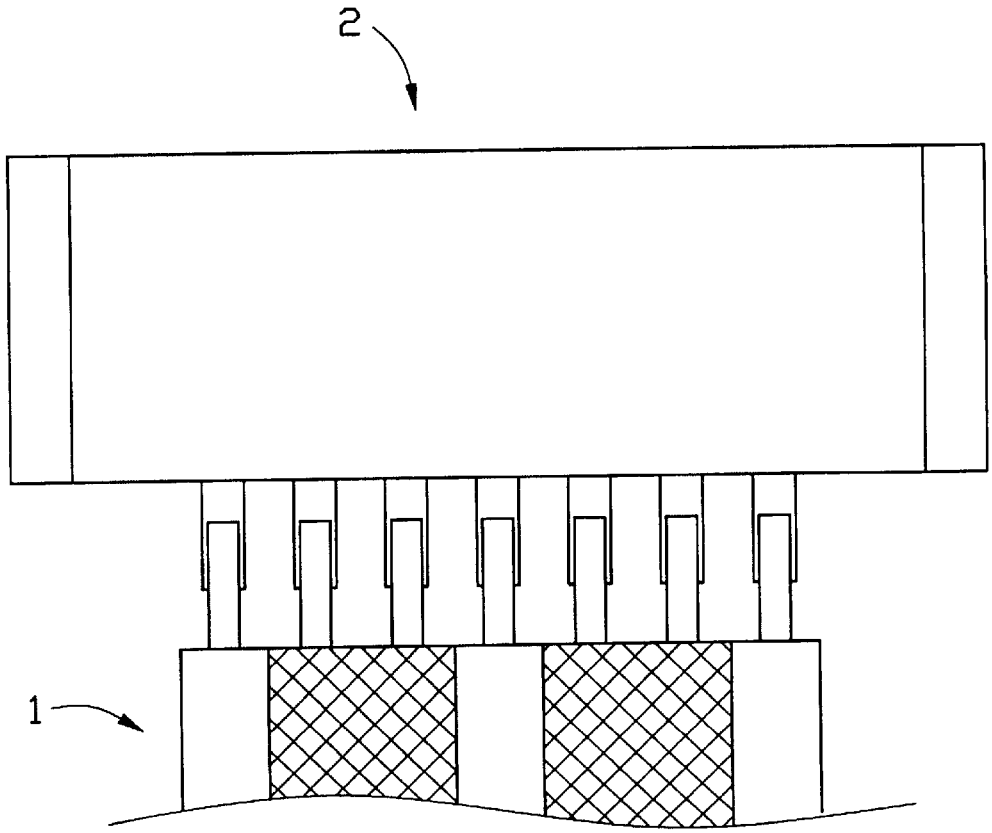
FIG. 2 is a top plan view of an electrical cable shown in FIG. 1.
Figure 3:
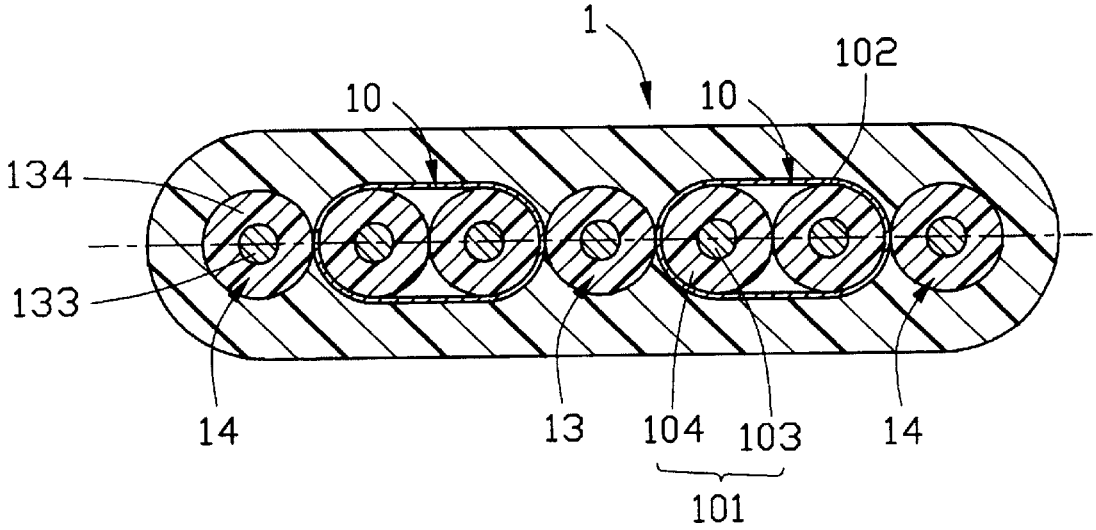
FIG. 3 is a cross-sectional view of the electrical cable shown in FIG. 2.
Figure 4:
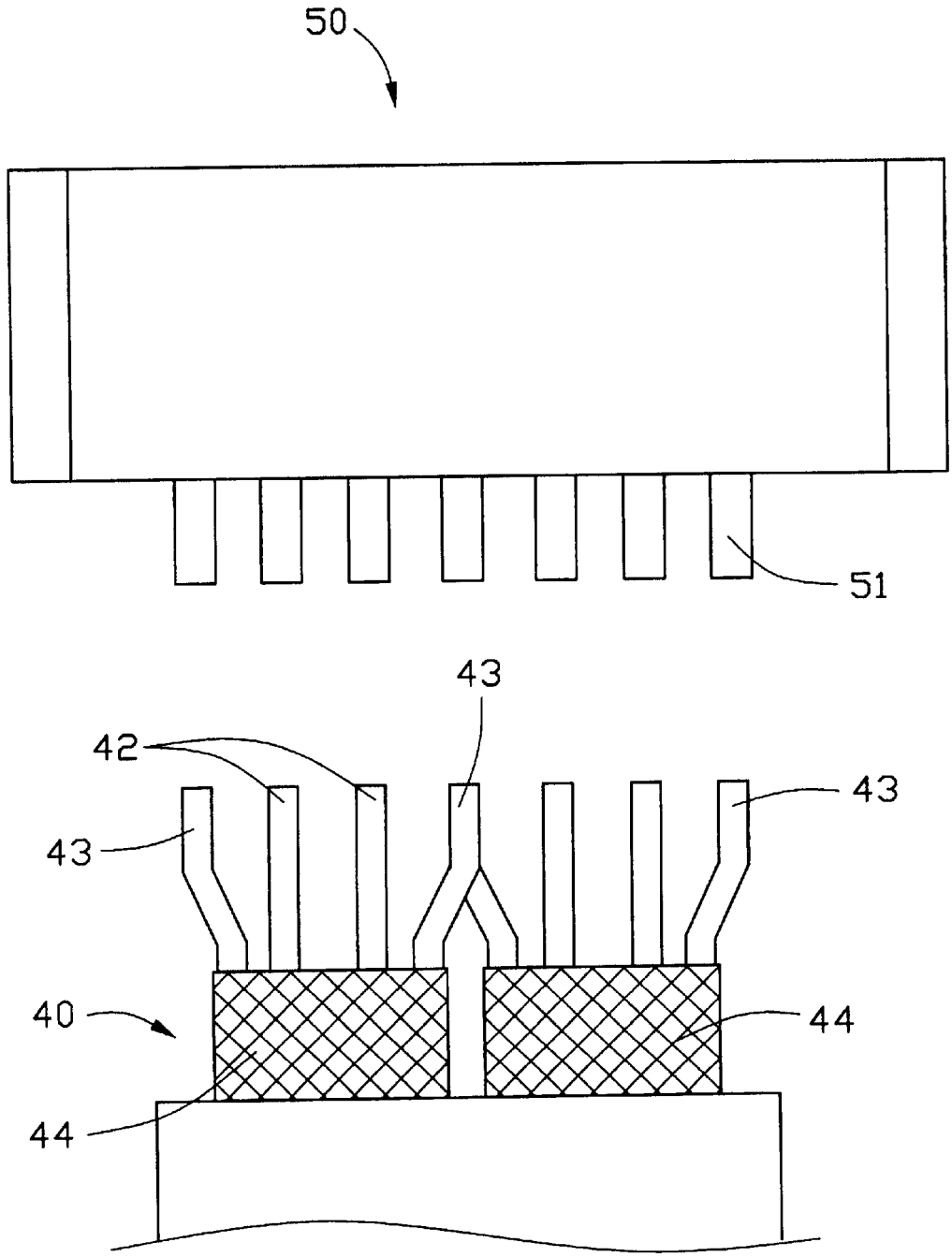
FIG. 4 (PRIOR ART)
FIG. 4 is a top plan view of a conventional shielded cable.
Figure 5:
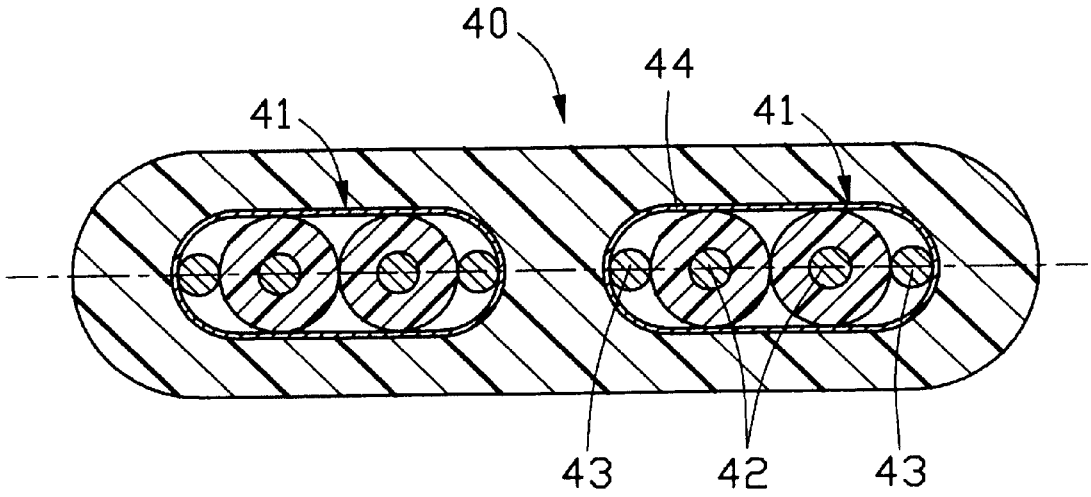
FIG. 5 (PRIOR ART)
FIG. 5 is a cross-sectional view of the conventional shielded cable shown in FIG. 4.

Referring to FIGS. 1 through 3, an electrical cable 1 in accordance with the present invention is adapted for terminating with a Serial Advanced Technology Attachment (ATA) connector 2 for signal transmission. The ATA connector 2 has a plurality of ground terminals 21, 22 and 23, and a plurality of signal terminals 24 accommodated therein. The pitches between the adjacent terminals are equal.

The electrical cable 1 comprises two cable subassemblies 10, one middle drain wire 13 and two outer drain wires 14 parallel arranged among the two cable subassemblies 10, and an insulating jacket 12 covering both the two cable subassemblies 10 and the drain wires 13, 14.

Each cable subassemblies 10 comprises a pair of signal wires 101 and a metal braid 102 surrounding the two signal wires 101 thereabout. The signal wire 101 includes a signal conductor 103 for transmitting data and an insulating layer 104 wrapping up the signal conductor 103. The middle drain wire 13 is positioned between inner sides of the neighboring cable subassemblies 10, and the two outer drain wires 14 are arranged at outer sides of the two cable subassemblies 10. Each drain wire 13, 14 comprises a center tin-copper conductor 133 and a layer 134 made from semiconductive material extruded around the center tin-copper conductor 133. Both the middle drain wire 13 and the outer drain wires 14 contact with the metal braids 102 of the cable subassemblies 10 through the semiconductive layers 134 thereof to achieve the grounding function. Ends of the signal wires 101 are soldered with the corresponding signal terminals 24 of the ATA connector 2 and the center tin-copper conductors 133 of the drain wires 13, 14 are soldered respectively with the corresponding ground terminals 21, 22, 23. Center lines of the signal wires 101 and the drain wires 13, 14 are fall on the same plane, and the distances between every two center lines are average and equal to the pitches of the terminals of the Serial ATA connector 2.

It is well known in the art that the semiconductive material is such a material that the electrical conductivity thereof are greater than insulators but less than good conductors, and the unit area impedance thereof changes when it is affected by light, heat or electricity. Comparing with the prior arts, the usage of the semiconductive material can increase the diameter of the drain wire 13, 14 so as to achieve a same distance between the center conductors of the drain wires 13, 14 and the signal wires 101 as the pitch of the terminals of the Serial ATA connector 2 for facilitating the soldering procedure. That is, using the semiconductive material to be extruded around the center conductors of the drain wires can adjust the distances between the drain wires and the signal wires to match the pitch which is required in any applications.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable adapted for terminating with an electrical connector having ground and signal terminals, comprising:

a pair of cable subassemblies arranged side by side, each cable subassembly having two signal wires and a metal braid wrapping up the two signal wires, the signal wire having a signal conductor in a center surrounded by an insulating layer;

three drain wires respectively positioned between and outside the two cable subassemblies and conductively contacting with the metal braids thereof, each drain wire comprising a center conductor and a semiconductive layer extruded around the center conductor, a spacing between the center conductor and an adjacent signal conductor being equal to a pitch between the two signal conductors of the cable subassembly; and an outer insulating jacket surrounding the pair of cable subassemblies and the drain wires.

2. The electrical cable as claimed in claim 1, wherein center lines of the drain wires and the signal wires are parallel to each other and fall on a same plane.

* * * * *